US005213048A

United States Patent [19]

Kunczynski

[11] Patent Number: 5,213,048

[45] Date of Patent: May 25, 1993

[54] CHAIRLIFT CHAIR ASSEMBLY WITH MOVABLE ENCLOSURE

[75] Inventor: Jan K. Kunczynski, Glenbrook, Nev.

[73] Assignees: Zygmunt Alexander Kunczynski; Alexander Jan Kunczynski, Carson City, Nev.

[21] Appl. No.: 782,344

[22] Filed: Oct. 24, 1991

[51] Int. Cl.[5] ..... B61B 7/00

[52] U.S. Cl. ..... 105/149.2; 104/173.2; 105/332; 105/341

[58] Field of Search ..... 104/173.2; 105/149.1, 105/149.2, 332, 341; 49/41, 40, 404, 409, 18, 360

[56] References Cited

U.S. PATENT DOCUMENTS

| | | | |
|---|---|---|---|
| 387,997 | 8/1888 | Pendleton | 104/230 |
| 1,908,659 | 5/1933 | Cross | 49/40 |
| 2,214,722 | 9/1940 | Seversky | 49/41 |
| 2,651,541 | 9/1953 | Surles | 49/41 |
| 2,994,572 | 8/1961 | Morrison | 49/40 |
| 3,747,974 | 7/1973 | Tauzin | 105/149.2 |
| 4,625,456 | 12/1986 | LaFontaine | 49/360 |
| 4,860,664 | 8/1989 | Kunczynski | 104/204 |
| 4,909,093 | 3/1990 | Mudford | 49/409 |

*Primary Examiner*—Mark T. Le

*Attorney, Agent, or Firm*—Flehr, Hohbach, Test, Albritton & Herbert

[57] ABSTRACT

A chair assembly (20) for chairlift including a seat (22) and enclosure member (43) mounted to the seat (22) for movement between open and closed positions. The chair assembly (20) has a drive (51) for moving the enclosure (43) which includes a rail (52) mounted to the movable enclosure member (43) and drive rollers (56, 57) carried by the frame (26) of the seat assembly (21). The drive rollers (56, 57) are powered by motion of the chair assembly (20) through actuator rollers (82, 83) that engage stationary actuator rails (84, 85) at the chair terminals. The actuator rollers (82, 83) are coupled by flexible drive cables (87, 88) to the drive rollers (56, 57) so that movement of the chair along the actuator rails (84, 85) produces rotation of the actuator rollers (82, 83) and the drive rollers (56, 57), which displaces the rail (52) and movable enclosure member (43).

17 Claims, 4 Drawing Sheets

CHAIRLIFT CHAIR ASSEMBLY WITH MOVABLE ENCLOSURE

TECHNICAL FIELD

The present invention relates, in general, to chair assemblies for chairlifts and the like, and more particularly, relates to chairlift chair assemblies which have movable protective, usually transparent, enclosures or bubbles.

BACKGROUND ART

Chair assemblies of the type used in chairlifts for skiing and sight-seeing typically are bench-type chairs which are mounted by a hanger arm from a haul rope. They usually are open to the elements or provide no protection against the cold and precipitation for the passengers. At various times, attempts have been made to partially enclose chairlift chair assemblies with transparent plastic bubbles, but this has posed substantial problems, particularly in the skiing industry. The enclosure must be movable to permit ingress and egress from the chair by passengers without special preparation and without stopping movement of the chairs. Thus, skiers must be able to get on and off the chair with their equipment on and while the chair is moving.

The approach which generally has been taken to the problem of enclosing chair assemblies has been to movably mount a plastic bubble to the chair and employ a lever system which can be actuated automatically at the end terminals of the chairlift to move the bubble enclosure between open and closed positions. Thus, a lever or arm is mounted on a movable enclosure, which arm will engage a force applying structure at the terminal as the chair is advanced. The inter-engagement between the enclosure lever and the stationary terminal opening device causes the bubble to be moved, usually by pivoting, to an open position as the chair enters the terminal. This permits the passengers to exit or enter the chair. As the chair leaves the terminal, a similar closure structure engages the same, or another lever or arm on the chair, to lower the enclosure over the passengers. Usually, the passengers also have the ability to raise or lower the enclosure manually while seated in the chair.

One of the serious problems that can occur with such lever-actuated chairlift enclosure systems is that, if an obstruction or passenger should interfere with the opening or closing of the bubble, the forces generated can become quite high and dangerous. Thus, if the enclosure is being closed by a lever against an object being carried by the passenger, such as ski poles, the lever can jam the bubble against the poles and/or passenger. The result can be injury to a passenger, bending of the poles, bending of the chair opening and closing components, or a combination of these problems.

An additional problem has been encountered in connection with the chairlift chair assemblies having movable bubble-type enclosures. In the open position the enclosures are extremely bulky. One typical prior art enclosure assembly is pivoted at the back of the chair so that the enclosure moves to an open position which extends outwardly of the chair by a substantial amount. This type of structure can make it difficult for the bubble to pass beyond the hanger arm, can pose excessive bulk problems in and around the terminal, and even undesirable aerodynamic drag during the opening and closing process. Retrofitting such a bulky structure to existing chair hanger arms, therefore, can be difficult or impossible.

Accordingly, it is an object of the present invention to provide chairlift chair assembly having a movable enclosure which obviates or minimizes the difficulties of the type previously described.

DISCLOSURE OF THE INVENTION

The chair assembly for a chairlift of the present invention includes a seat assembly for support of a passenger thereon, and an enclosure mounted to the seat assembly for movement between a closed position defining a passenger protecting volume above the seat assembly, and an open position, permitting ingress and egress of a passenger to the seat assembly. The improvement in the chair assembly of the present invention comprises, briefly, a drive assembly including a drive rail and drive rollers frictionally engaging the drive rail to effect relative displacement therebetween, with one of the drive rail and the rollers being mounted to the enclosure, and the other of the drive rail and rollers being mounted to a portion of the seat assembly. Thus, movement of the enclosure between the open and closed positions is produced by rotation of the drive wheels. In the preferred form, the drive rollers are coupled by rotatable flexible drive cables to actuator rollers which frictionally engage a stationary rail mounted along the path of the chair assembly. As the chair advances, therefore, the actuator rollers engage the terminal rails and rotate the flexible drive cables. The drive cables, in turn, rotate the drive rollers on the chair which frictionally engage a rail mounted to the enclosure and produce displacement of the bubble enclosure between the opened and closed positions.

BEST MODE OF CARRYING OUT THE INVENTION

Figure 1:
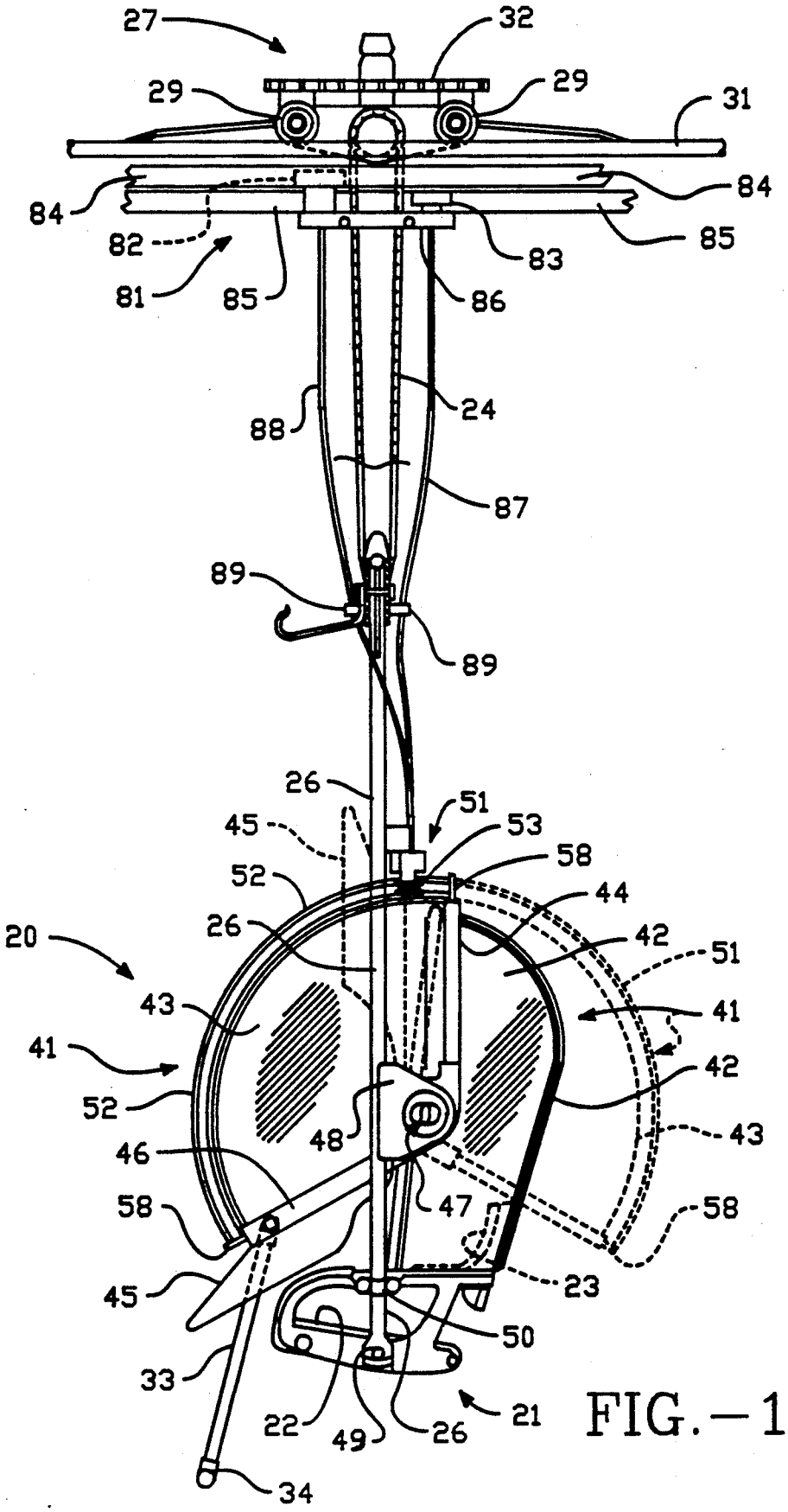
FIG. 1 is a side elevation view of a chairlift chair assembly constructed in accordance with the present invention and showing the enclosure in solid lines in a closed position and broken lines in an open position.
Figure 2:
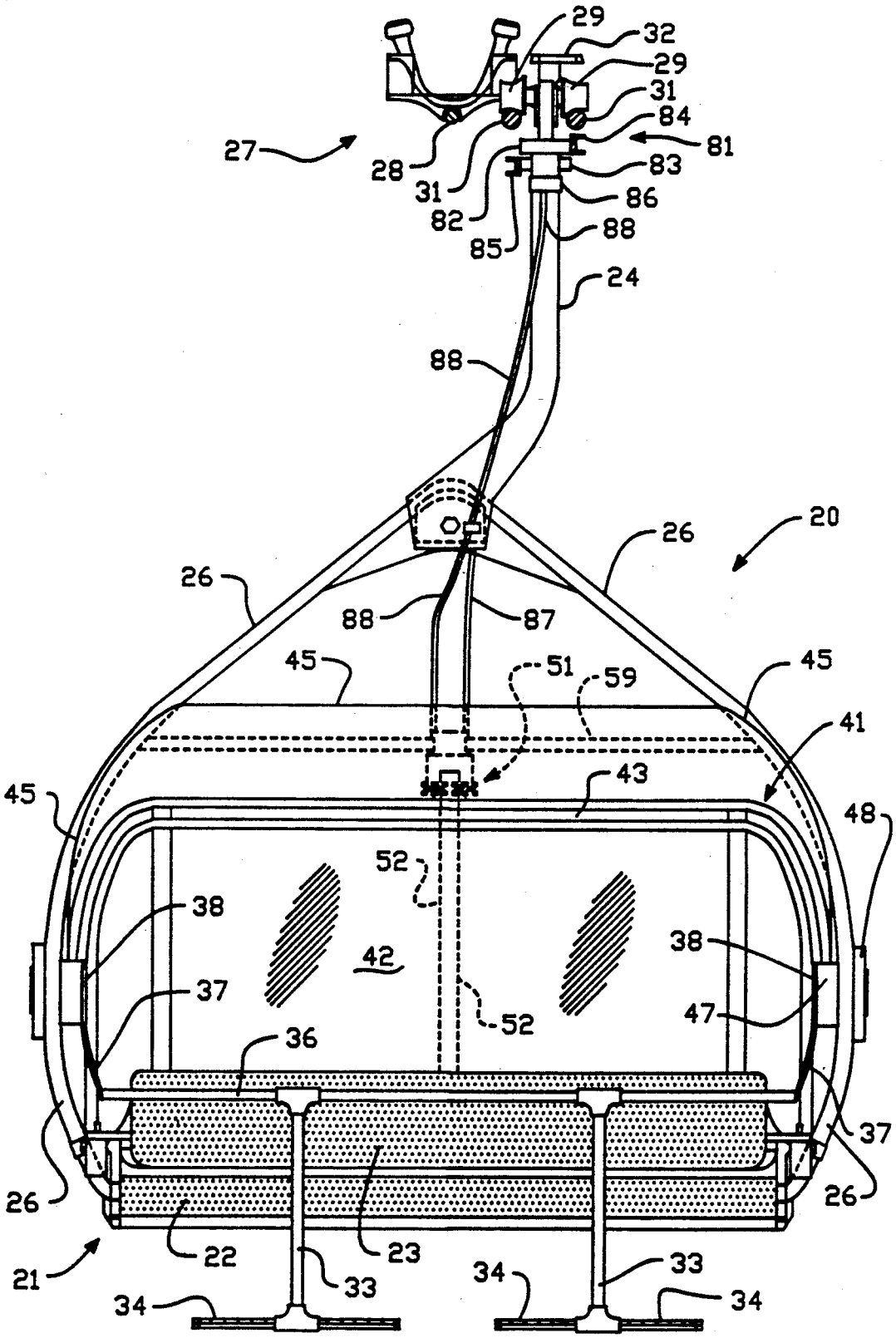
FIG. 2 is a front elevation view of the chair assembly of FIG. 1 with the enclosure in an open position.

The chairlift chair assembly of the present invention, generally designated 20, can be seen from FIGS. 1 and 2 to include a bench-type seat assembly, generally designated 21, in which there is a seat 22 and seat back 23, both mounted to a seat frame assembly. The seat frame assembly includes a hanger arm 24 from which tubular, inverted, U-shaped frame member 26 downwardly depends and is secured to seat assembly 21 by brackets 49 and 50. Mounted to an upper end of hanger arm 24 is a grip assembly, generally designated 27, which releasably grips haul rope 28. Grip assembly 27 may advantageously take the form as described in detail in my U.S. Pat. No. 4,860,664. Such a grip assembly also is accomplished by support rollers 29, which engage support rails 31 when the chair assembly is at a terminal and detached from haul rope 28. A drive shoe 32 is used to drive the detached chair through the terminal by means of drive wheels (not shown) at the terminal.

The chair assembly of the present invention is particularly well-suited in the skiing industry and typically will further include as an optional feature, footrest assemblies 33 which are in the form of T-bars having horizontal members 34 on which the passenger's skies can be rested. The T-bars are mounted to a transversely-extending bar 36, which in turn is mounted on a pair of forwardly extending arms 37. A pivotal mounting assembly 38 allows the entire T-bar footrest assembly to be pivoted to an elevated position allowing the skier to get in and out of seat assembly 21. Usually pivotal mount 38 includes spring biasing means (not shown) providing biasing of the T-bar assembly to the elevated or upward position. The passengers seated on the seat assembly can grab bar 36 and pull the same down to the position of FIGS. 1 and 2 against the slight upward biasing and then place their skies on footrest bars 34.

As thus far described, the chairlift chair assembly is broadly known in the art. The present chair assembly, however, further includes enclosure means, generally designated 41, which is mounted to seat assembly 21 for movement between a closed position, shown in FIG. 1, to an open position, shown in broken lines in FIG. 1 and in solid lines in FIG. 2. In the closed position, enclosure means 41 defines, at least partially, a passenger protecting or surrounding volume above seat 22. The passenger is not entirely enclosed since his or her legs must come out over the front of the seat and are rested on T-bar horizontal members 34. Nevertheless, the passenger's upper body is substantially protected from the elements during movement of the chair assembly.

In the present invention, enclosure means 41 is comprised of two enclosure components or portions, namely, a stationary back enclosure portion 42 and a movable front enclosure portion 43. Both enclosure portions are shell-like members which are preferably transparent sheets of plastic mounted to supporting frame members. Front enclosure 43 also advantageously includes a front apron member 45 which moves with it. Apron 45 extends outwardly and downwardly from bubble portion 43 to shield the passenger's knees and legs from snow and water which may fall or drip off the bubble 43.

It is an important feature of the movable enclosure of the chair assembly of the present invention that movable enclosure portion 43 is mounted for movement to an open position which is nested outwardly and behind stationary enclosure portion 42. As best may be seen in FIG. 1, this is accomplished in the chair assembly of the present invention by mounting front enclosure portion 43 to movable frame members 44 and 46. Frame members 44 and 46 extend to a pivotal mounting assembly 47 carried by bracket 48, which in turn is secured to tubular chair frame member 26. The pivot point of pivotal mount 47 can be seen to be at about mid-height of the enclosure assembly 41 and close to seat support frame 26. (Footrest assembly pivot 38 and 47 are in generally concentric relation for compactness.) This positions pivot 47 at about the middle of chair assembly 20 and well in advance of back portion 42. As so positioned, the movable front portion 43 of the enclosure can be displaced to the dotted line position shown in FIG. 1, in a manner which will be described in more detail hereinafter. In the displaced position, however, the movable front enclosure portion 43 and stationary rear enclosure portion 42 are in a nested condition which does not substantially increase the overall bulk of the chair assembly. Movement between open and closed positions, moreover, does not result in movable portion 43 swinging upwardly in a manner which would require a special hanger arm or frame member 26 in order to allow movement of the enclosure or bubble therepast. Moreover, as nested together in the open position, the two enclosures do not have a frontal area which is substantially increased, as compared to the closed position.

Displacement of movable enclosure 43 between the open and closed positions is accomplished in the chairlift assembly of the present invention by using a drive means, generally designated 51, which preferably is operated as a result of motion of the chair. Drive means 51 is constructed so that it will not jam or expose the passengers to substantial opening and closing forces. Drive means 51 includes rail means 52 and drive roller means 53. While it is preferable that rail means 52 be provided by a rail member mounted in spaced relation to the exterior of shell-like enclosure member 43, it will be understood that in the broadest sense rail means 52 can be any relatively rigid structural member carried by or forming a part of enclosure member 43. Thus, a frame member for enclosure 43, or even the transparent panels could be engaged by drive roller means 53. As best may be seen in FIGS. 3 and 4, however, drive roller means 53 is preferably provided by a pair of drive rollers 56 and 57 which frictionally engage a single arcuate or curved drive rail 52 having a circular cross-section.

In the form of the invention shown in the figures, rail 52 is mounted to movable enclosure 43, for example, by end mounting brackets 58, which preferably position the rail at about the transverse midplane of the seat (FIG. 2). Roller assembly 53 is mounted to the seat assembly frame, namely, on transversely-extending frame member 59 by mounting bracket 61 (see FIG. 5). As will be understood, it is within the scope of the present invention for rail means 52 to take the form of one or more rails, which can be mounted at different locations to the movable enclosure 43. Similarly, roller means 53 can be a single roller, or a plurality of rollers within the scope of the present invention. It would even be possible, although not as efficient or desirable, to provide a reversal of parts in which the roller assembly is carried by the movable partition 43 and the rail is carried by the seat assembly frame. There is several disadvantages to this approach, including the presence of the rail in a stationary position, either in front of or behind the chair, and the problems associated with coupling the drive rollers for the transmission of drive forces to them as the drive roller assembly is displaced along the rail.

Figure 3:
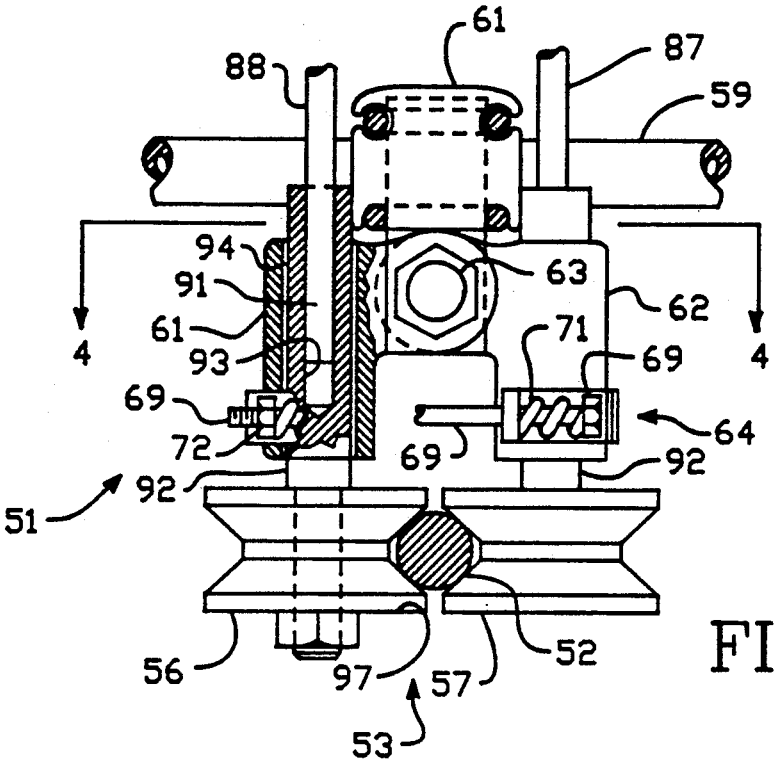
FIG. 3 is an enlarged, front elevation view, partially broken away, of the drive assembly of the present invention.
Figure 4:
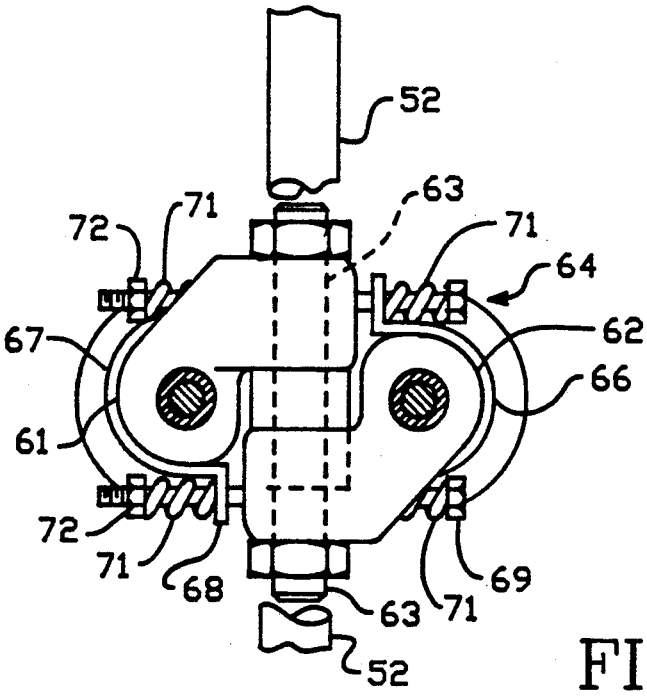
FIG. 4 is a top plan view of the drive assembly taken substantially along the plane of line 4—4 in FIG. 3.
Figure 5:
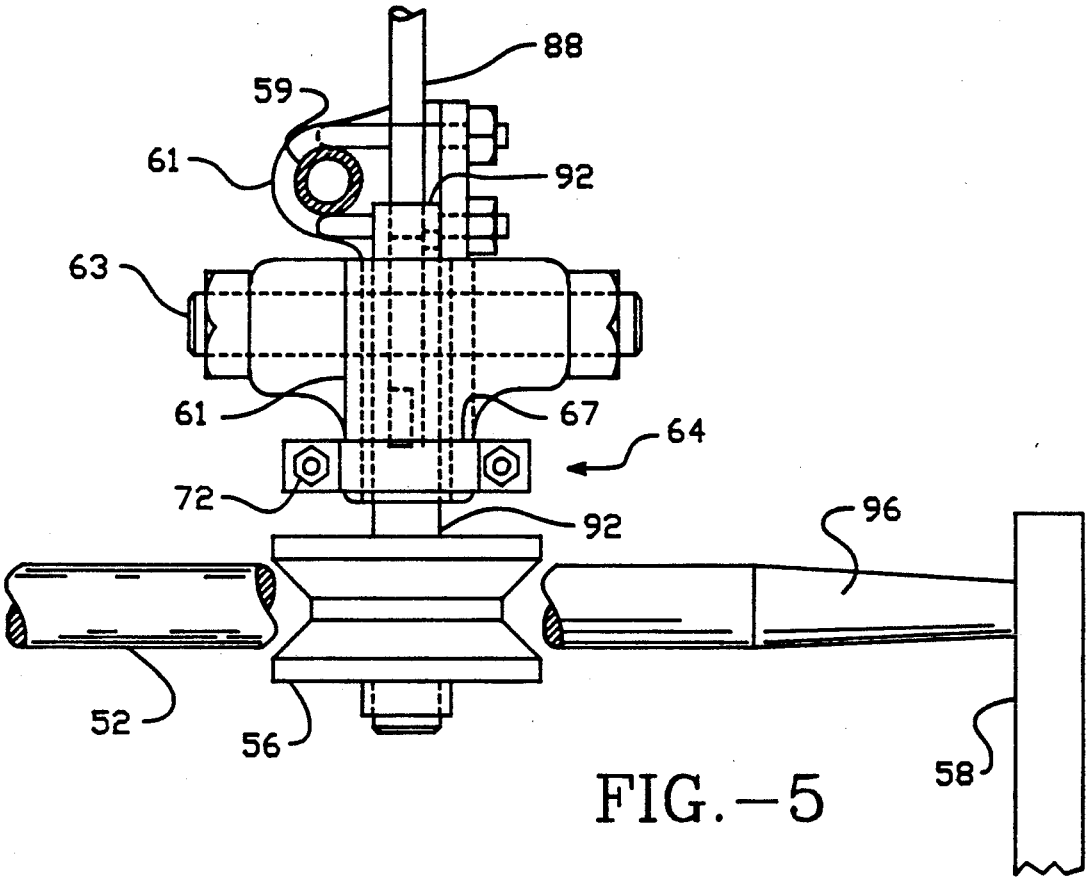
FIG. 5 is a side elevation view of the drive assembly of FIG. 3.

As best may be seen in FIGS. 3–5, in the preferred form of the invention a pair of V-shaped drive rollers 56 and 57 are mounted for rotation in housings 61 and 62, respectively. These housings are pivotally mounted to a common axial 63 and spring biased toward each other and toward rail 52 by a spring biasing assembly, generally designated 64. Biasing assembly 64, therefore, urges the V-shaped rollers 56 and 57 into frictional engagement with rail 52 by a biasing force which can be adjusted. As shown in the drawing, the spring biasing of housing 61 and 62, and accordingly the drive rollers, towards each other is accomplished by a pair of U-shaped brackets 66 and 67 having end flanges 68 with apertures formed to slidably receive bolts 69 therethrough. Compression springs 71 can be provided at one end, and preferably both ends, of bolts 69, and a nut 72 is threadably mounted on each of the bolts. Tightening of nuts 72, therefore, allows the clamping force or biasing force about axial 63 to be adjusted to apply the desired force on rail 52. In practice, between about 150 and 200 pounds of force is usually employed by adjusting biasing or clamping assembly 64.

V-shaped rollers 56 and 57 are advantageously formed of a high friction material, such as the material used in automobile brake pads. The biasing force, together with the V-shaped configuration and round cross-section of the rail are sufficient to cause any snow or ice on the rail to break and fall away so that the drive wheels can drive or propel the rail and movable enclosure member 43 between the open and closed positions even in adverse weather conditions.

As best can be seen in FIG. 1, drive rail 52 is an arcuate member mounted on the outwardly facing side of enclosure 43 and having a substantial radius of curvature about the center of pivoting 47 of the movable enclosure member. Thus, rail 52 can be seen to be positioned at a substantial distance from the transverse pivotal axis of the movable enclosure so as to afford a substantial lever arm for applying drive forces to the movable enclosure member. Since the enclosure member is usually a light plastic mounted to lightweight frame members, the overall enclosure is not extremely heavy. Use of a substantial lever arm accordingly ensures that the driving forces used to open and close the bubble do not have to be very high.

In the chair assembly of the present invention, driving forces preferably are transmitted to drive rollers 56 and 57 by taking advantage of the motion of the chair along the chairlift path or course. Instead of employing a lever system which can bind, bend and/or endanger passengers, however, the drive rollers in drive assembly 51 of the chair of the present invention are driven by drive actuator means, generally designated 81. Actuator means 81 preferably include two actuator rollers 82 and 83 positioned to frictionally engage stationary actuator rails 84 and 85. Rails 84 and 85 typically are provided at the loading and unloading terminals of the chairlift, and as may be seen in FIG. 2, are positioned at vertically staggered or displaced heights on opposed sides of hanger arm 24. Rollers 82 and 83 are rotatably mounted to support bracket 86 carried by hanger arm 24 in a virtually staggered relationship to frictionally engage the corresponding actuator rails. Coupled to rollers 82 and 83 are a transmission coupling means, preferably rotatable flexible drive cables 87 and 88. The flexible drive cables 87 and 88 extend for rotation through guide eyelets 89 and are coupled at their lower ends 91 (see FIG. 3) to drive shaft assemblies 92 for drive wheels 56 and 57. Thus, drive shafts 92 have bores 93 and receiving ends 91 of the flexible drive cables, and shafts 92 are mounted in bearings 94 provided inside housings 61 and 62.

In operation, as the chair moves while attached to haul rope 28 or driven by terminal drive wheel shoe 32, the actuator rollers 82 and 83 become frictionally engaged with actuator rails 84 and 85 and rotate in opposed directions. The opposed rotation of the actuator rollers is transmitted by drive cables 87 and 88 to the drive rollers 56 and 57. Opposed rotation of drive rollers 56 and 57, therefore, advances rail 52 and movable enclosure portion 43 from the closed position to the open position, or if the rails are positioned on opposite sides of actuator rollers, from the open position to the closed position. The same set of actuator rollers 82 and 83 can be used to drive rail 51 and enclosure 43 between the open position and closed position merely by positioning actuator rails 84 and 85 on the desired side of the actuator rollers.

It is an important feature of the chairlift chair enclosure drive assembly of the present invention that the system inherently is much safer for passengers and much less capable of being jammed than lever-based prior art systems. Thus, should the enclosure portion 43 be driven down onto a passenger or an object being carried by the passenger, such as ski poles, the drive wheels 56 and 57 can begin to slip relative to drive rail 52. The use of an arcuate rail located at a substantial radial distance from the pivot point allows the driving forces to be modest in size. Moreover, springs 71 of biasing assembly 64 permit drive rollers 56 and 57 to separate under modest resistance so that the drive rollers will slip relative to the rail. Rather than provide a mechanism whereby the full force of the advancing chair is brought to bear upon the passenger, the drive roller-rail assembly does not expose the passenger to substantial forces.

In this regard, it is further preferred that rail 52 be provided with ends which are tapered approximate the end mounting brackets 58. Thus, taper portion 96 (FIG. 5) will allow the drive rollers to move toward each other under the biasing of assembly 64 until the rims 97 come into contact. This acts as a form of clutch mechanism at the ends of the rails which prevents the drive rollers from damaging the end brackets. Movable enclosure member 43, for example, can be opened manually by the passengers prior to entry into an unloading terminal having actuator rails that will power the drive rollers in a manner tending to open the enclosure further. The already open enclosure would tend to be driven further open, but tapered rail portion 96 causes the drive roller contact with rail 52 to be minimized and force on end brackets 58 to be extremely low or nonexistent.

The method of the present invention of displacing a chairlift chair assembly enclosure between the open and closed positions, therefore, will be understood to include the steps of frictionally engaging a portion of the movable enclosure, such as drive rail 52, with drive roller means 53 and rotating the drive rollers to displace the enclosure. Advantageously, the drive rail is an arcuate rail mounted at a substantial radial distance from a transverse pivotal axis of the enclosure to provide the mechanical advantage allowing the driving forces to be modest in size. Roller assembly 53 can drive the enclosure effectively and yet can slip or breakaway from the rail if the movable enclosure is at the end of its path or closes against the passenger.

What is claimed is:

1. In a chair assembly for a chairlift including a seat assembly for support of a passenger thereon movable enclosure means mounted to said seat assembly for movement between a closed position defining a passenger protecting volume above a portion of said seat assembly and an open position permitting ingress and egress of a passenger to said seat assembly, and drive means coupled to said movable enclosure means for displacement of said movable enclosure means between said open position and said closed position, wherein the improvement in said chair assembly comprises:

drive means including a drive rail mans and drive roller means frictionally engaging said drive rail means to effect relative displacement therebetween, one of said rail means and said roller means being carried by said movable enclosure means and the other of said rail means and said roller means being mounted to said seat assembly to effect movement of said movable enclosure means upon rotation of said roller means, and said roller means being mounted for movement toward and away from said drive rail means and being spring biased in a direction toward said drive rail means by spring biasing assembly, said spring biasing assembly including means for adjusting the biasing force applied to said roller means to control the force at which said roller means will slip relative to said drive rail means in response to a force applied to said movable enclosure means in a direction opposite the movement of said movable enclosure means; and drive actuator means coupled to drive said drive roller means, said drive actuator means being formed to produce rotation of said drive roller means during and as a result of movement of said chair assembly along a path of said chairlift.

2. The chair assembly as defined in claim 1 wherein, said rail means is carried by said movable enclosure means, and said roller means is mounted to said seat assembly.

3. The chair assembly as defined in claim 2 wherein, said movable enclosure means includes a shell-like movable enclosure member, said chair assembly includes a stationary enclosure means including a shell-like stationary enclosure member, said rail means is provided as a rail carried by said movable enclosure member, said chair assembly includes frame means, and said roller means is mounted to said frame means.

4. The chair assembly as defined in claim 3 wherein, said movable enclosure member is pivotally mounted to said frame means, and said movable enclosure member pivots between said closed position to an open position nesting with said stationary enclosure member.

5. The chair assembly as defined in claim 4 wherein, said seat assembly includes a seat back, said stationary enclosure member is mounted proximate said seat back and extends upwardly to a height above the height of a passenger seated on said seat assembly, and said movable enclosure member is mounted for pivotal movement to said open position with said movable enclosure member nested outwardly and behind said stationary enclosure member.

6. The chair assembly as defined in claim 2 wherein, said movable enclosure means includes a shell-like movable enclosure member having a downwardly and outwardly depending apron mounted thereto, said enclosure member being pivotally mounted to said seat assembly for movement about a transversely oriented pivotal axis, and said rail means is an arcuate member mounted to an outwardly facing said of said movable enclosure member and having a radius of curvature from said pivotal axis providing a substantial lever arm from said pivotal axis for applying driving forces to move said movable enclosure member.

7. In a chair assembly for a chairlift including a seat assembly for support of a passenger thereon, movable enclosure means mounted to said seat assembly for movement between a closed position defining a passenger protecting volume above a portion of said seat assembly and an open position permitting ingress and egress of a passenger to said seat assembly, and drive means coupled to said movable enclosure means for displacement of said movable enclosure means, between said open position and said closed position, wherein the improvement in said chair assembly comprises:

drive means including a drive rail means and drive roller means frictionally engaging said drive rail means to effect relative displacement therebetween, and one of said rail means and said roller means being carried by said movable enclosure means and the other of said rail means and said roller means being mounted to said seat assembly to effect movement of said movable enclosure means upon rotation of said roller means; and drive actuator means coupled to drive said roller means, said drive actuator means being formed to produce rotation of said roller means during and as a result of movement of said chair assembly along a path of said chairlift.

8. The chair assembly as defined in claim 7, wherein, said drive actuator means includes actuator roller means positioned to frictionally engage stationary actuator rail means mounted along the path of said chairlift, and rotation transmission coupling means extending between and transmitting rotational movement from said actuator roller means to said drive roller means.

9. The chair assembly as defined in claim 8 wherein, said rotation transmission coupling means is provided by a rotatable flexible drive cable.

10. The chair assembly as defined in claim 7 wherein, said rail means is provided as an arcuate rail member mounted to an outwardly facing side of said movable enclosure means, said chair assembly includes seat frame means, said movable enclosure means is pivotally mounted to said seat frame means, said drive roller means is provided as a pair of drive rollers mounted to said seat frame means in a position to engage opposite sides of said rail member, said drive means includes a pair of flexible drive cables coupled at one end to said drive rollers and a pair of actuator rollers coupled to an opposite end of said drive cables, said actuator rollers being mounted for rotation to said seat frame means in a position to engage and be frictionally rotated by stationary actuator rail means mounted along the path of movement of said chair assembly.

11. The chair assembly as defined in claim 10 wherein, said movable enclosure means is provided by a sector of generally cylindrical shell-like movable enclosure member having a substantial radius of curvature from a transverse pivotal axis, and said shell-like movable enclosure member is pivotally mounted to said seat assembly by pivotal mounting means provided on opposite ends of said shell-like movable enclosure member.

12. The chair assembly as defined in claim 11 wherein, said rail member is an arcuate rod having a circular cross-section mounted in spaced relation to an outwardly facing side of said shell-like movable enclosure member proximate a mid-plane between said opposite ends.

13. The chair assembly as defined in claim 12 wherein, said drive rollers are V-shaped rollers formed of a high-friction material.

14. The chair assembly as defined in claim 7 wherein, said drive roller means includes biasing means for biasing said drive roller means into frictional engagement with said rail means.

15. The chair assembly as defined in claim 14, wherein, said biasing means is provided by adjustable spring biasing means.

16. A method of displacing a movable enclosure member mounted to a chairlift chair assembly between a closed position and an open position comprising the steps of:

frictionally engaging arcuate drive rail means carried by said movable enclosure member with drive roller means mounted to said chair assembly, in such a manner to permit slipping of said drive roller means relative to said drive rail means at a selected force threshold, said movable enclosure member being mounted to said chair assembly for pivotal movement about a transverse pivotal axis, and said drive rail means located at a substantial radial distance from said transverse pivotal axis; and rotating said drive roller means to displace said movable enclosure member by rotating actuator rollers coupled to drive said drive roller means by engagement of said actuator rollers with an actuator rail proximate a path of said chair assembly while said chair assembly is moving down said path.

17. The method as defined in claim 16 wherein, said step of rotating said drive roller means in relatively nested relation to a stationary enclosure member mounted to said chair assembly.

* * * * *